US010490381B2

(12) United States Patent
Caryotakis et al.

(10) Patent No.: US 10,490,381 B2
(45) Date of Patent: Nov. 26, 2019

(54) SHEET BEAM KLYSTRON (SBK) AMPLIFIERS WITH WRAP-ON SOLENOID FOR STABLE OPERATION

(71) Applicant: Qmast LLC, Banning, CA (US)

(72) Inventors: George Caryotakis, Lincoln, CA (US); Peter M. Kearl, Grand Junction, CO (US)

(73) Assignee: Qmast LLC, Grand Junction, CO (US)

( * ) Notice: Subject to any disclaimer, the term of this patent is extended or adjusted under 35 U.S.C. 154(b) by 694 days.

(21) Appl. No.: 14/476,599

(22) Filed: Sep. 3, 2014

(65) Prior Publication Data

US 2015/0060052 A1 Mar. 5, 2015

Related U.S. Application Data

(60) Provisional application No. 61/959,872, filed on Sep. 4, 2013.

(51) Int. Cl.

| | |
|---|---|
| ***E21B 43/24*** | (2006.01) |
| ***H01J 23/12*** | (2006.01) |
| ***H01J 23/38*** | (2006.01) |
| ***H01J 23/54*** | (2006.01) |
| ***H01J 25/10*** | (2006.01) |
| ***H01J 25/18*** | (2006.01) |
| ***H01J 23/087*** | (2006.01) |

(52) U.S. Cl.

CPC ..... *H01J 23/087* (2013.01); *E21B 43/2401* (2013.01); *H01J 23/12* (2013.01); *H01J 23/38* (2013.01); *H01J 23/54* (2013.01); *H01J 25/10* (2013.01); *H01J 25/18* (2013.01)

(58) Field of Classification Search

None

See application file for complete search history.

(56) References Cited

U.S. PATENT DOCUMENTS

| | | | | | |
|---|---|---|---|---|---|
| 3,806,755 | A | * | 4/1974 | Lien | H01J 23/027 315/3.5 |
| 3,925,701 | A | * | 12/1975 | Wolfram | H01J 23/0275 315/3.5 |
| 3,936,695 | A | * | 2/1976 | Schmidt | H01J 23/027 315/3.5 |
| 4,137,482 | A | | 1/1979 | Caryotakis et al. | |
| 4,533,875 | A | * | 8/1985 | Lau | H01J 25/025 315/3 |
| 4,550,271 | A | * | 10/1985 | Lau | H01J 25/025 315/393 |
| 6,060,833 | A | * | 5/2000 | Velazco | H05H 7/16 315/5.41 |

(Continued)

FOREIGN PATENT DOCUMENTS

GB 1191755 A 5/1970

OTHER PUBLICATIONS

STIC research report of patent and Non patent literature.*

(Continued)

*Primary Examiner* — Dion Ferguson
*Assistant Examiner* — Srinivas Sathiraju
(74) *Attorney, Agent, or Firm* — Edwin L. Hartz

(57) ABSTRACT

A microwave energy tool including a sheet beam klystron that includes a tube body for carrying an electron sheet beam that has a plurality of cavities and a magnetic solenoid wound directly on the tube body.

6 Claims, 9 Drawing Sheets

(56) References Cited

U.S. PATENT DOCUMENTS 6,831,933 B2 * 12/2004 Biedron ..... H01S 3/0959 372/109
7,339,320 B1 * 3/2008 Meddaugh ..... H05H 9/048 315/5.41
7,750,572 B2 * 7/2010 Bariou ..... H01J 23/027 315/3
7,828,057 B2 * 11/2010 Kearl ..... E21B 43/2401 166/248
8,040,189 B2 * 10/2011 Leek ..... H05H 9/00
8,076,853 B1 * 12/2011 Caryotakis ..... H01J 25/10
8,324,809 B2 * 12/2012 Gardelle ..... H01J 25/10
8,384,314 B2 * 2/2013 Treas ..... H05H 7/02 250/390.1
8,427,057 B2 * 4/2013 Durand ..... H01J 23/005 315/3.5
8,441,191 B2 * 5/2013 Protz ..... H01J 25/10 315/5.39
8,525,588 B1 9/2013 Hwu et al.
8,581,525 B2 * 11/2013 Antaya ..... H05H 7/10 315/500
8,648,760 B2 * 2/2014 Parsche ..... E21B 36/04 324/303
8,847,489 B2 9/2014 Teryaev et al.
8,975,816 B2 * 3/2015 Scheitrum ..... H01J 23/38 315/5.16
9,035,707 B2 * 5/2015 Obata ..... H01J 23/213 315/39.51
9,451,689 B2 * 9/2016 Tsutsui ..... H05H 13/02
2008/0068112 A1 * 3/2008 Yu ..... H01P 1/16 333/228
2008/0258625 A1 * 10/2008 Kowalczyk ..... H01J 23/36 315/5.13
2010/0148895 A1 * 6/2010 Antaya ..... H05H 7/04 335/216
2011/0266951 A1 * 11/2011 Andre ..... H01J 23/02
2011/0291559 A1 * 12/2011 Caryotakis ..... H01J 25/10
2012/0126726 A1 * 5/2012 Antaya ..... H05H 13/005
2013/0015763 A1 * 1/2013 Scheitrum ..... H01J 23/38
2013/0213637 A1 * 8/2013 Kearl ..... E21B 43/2405 166/248

OTHER PUBLICATIONS

Baston "Formation and Transport of . . . Microwave devices" 1996 University of Wisconsin Madison. PhD thesis.*

Okihira "A C-Band accelerator for X-ray free electron laser (XFEL) facility" Mitshibhishi Heavy industris Technical review vol. 49 No. 2 Jun. 2012 p. 27-31.*

Jensen, Aaron, et al., "200 KW CW Sheet Beam Klystron Research and Development," IEEE, 2014.

Jensen, Aaron, et al., "Sheet Beam Klystron for the Navy FEL," SLAC-PUB-15330, Nov. 2012.

Bane, K.L.F., et al., "Sheet Beam Klystron Instability Analysis," SLAC-PUB-13602, May 2009.

Jensen, Aaron, et al., "8.5: Stability Review of SLAC's L-Band Sheet Beam Kystron," IEEE, 2011.

Cusick, Michael, et al., "X-Band Sheet Beam Klystron (XSBK)," IEEE, 2009.

International Search Report and Written Opinion for PCT/US2014/053934, dated Dec. 5, 2014 (8 pages).

* cited by examiner

SHEET BEAM KLYSTRON (SBK) AMPLIFIERS WITH WRAP-ON SOLENOID FOR STABLE OPERATION

PRIORITY CLAIM

The present application claims priority to U.S. provisional application Ser. No. 61/959,872, filed Sep. 4, 2013, with the same title as above, and which is incorporated herein by reference in its entirety.

BACKGROUND

Klystrons are microwave amplifiers, invented at Stanford University before World War II, and since used extensively in power sources for electron accelerators used in Medicine and High Energy Physics; and in transmitters for radar, UHF television, and satellite communications. In a conventional Klystron, a cylindrical electron beam, confined by an electromagnet, traverses and interacts with a number of resonant cavities, amplifying an input signal by 30-60 dB. The cavities are electrically isolated from each other by the cylindrical beam drift tube, which is too small to propagate the operating frequency. The size of the drift tube and the optics of the electron "gun", where the beam is generated, place an upper limit on the current, and hence the power, of the device.

The Sheet Beam Klystron ("SBK") is a microwave power amplifier that was developed at the Stanford Linear Accelerator Center ("SLAC") in the early 1990s as a lower cost alternative to conventional klystrons for a future collider requiring thousands of powerful microwave sources. Since then, a variety of scientific, commercial, and military applications, requiring very high average (or peak) power together with light weight, resulted in several funded efforts to build SBKs, all of which failed. A recent study at SLAC revealed an inherent instability in the SBK. Based on this study, a need exists for a modification in the SBK configuration, to make it a viable high-power microwave source.

In an SBK, the electron beam is flat and can be extended laterally; the beam can therefore carry a higher current with lower current density. In the original SLAC work beam confinement was accomplished with "periodic permanent magnet" focusing ("PPM"), which was facilitated because of the lower current density of SBKs. For reasons peculiar to periodic focusing in combination with a sheet beam, the PPM focused SBKs developed to date employed beams confined with a Brillouin, rather than a stronger field, which is the practice for PPM-focused travelling wave tubes. Brillouin is the lowest axial magnetic field force necessary to confine a cylindrical or sheet beam, by neutralizing the outward force produced by the space charge in the beam. A problem with existing SBKs, however, is that the wide drift tube supports propagating modes, which can be "trapped", i.e. form standing waves with strong transverse electric fields that can drive the electron beam into the drift tube walls.

Today, deep seated shale deposits across the country are being exploited with hydrofracture or "fracking", a controversial but effective process involving large quantities of water mixed with sand and proprietary chemicals. Fracking is under attack as a serious menace to the environment, but it is viewed as a potential answer to the dependence on imported oil.

A potential alternative to fracking is described in U.S. Pat. No. 7,828,057 and U.S. Patent Application Publication No. US2013/0213637, both of which are incorporated by reference herein in their entirety. The Patent discloses a process where hydrocarbons are extracted from a target formation, such as oil shale, oil (tar) sands, heavy oil and petroleum reservoirs, methods which cause fracturing of the containment hydrocarbon rock and liquefaction or vaporization of the by microwave energy directed by a radiating antenna in the target formation. The microwave power vaporizes the water within the shale layer, and if kerogen is present, it is heated for liquefaction or vaporization. The resulting steam breaks up the rock, releasing gas and oil. In the process, the shale matrix becomes more transparent to microwaves (its loss tangent is reduced) allowing microwave power to penetrate deeper into the shale, thus expanding the volume of exploited shale around the borehole. The antenna in the target area is connected via a transmission line to a high power klystron located on the surface and producing one-half megawatt or greater microwave energy at 2 Gigahertz or higher frequency. The published patent application (Pub. No. 2013/0213637) discloses the location of the klystron in the target area near the antenna.

SUMMARY

In one general aspect, the present invention is directed to light weight, very high average power SBKs for a variety of applications; and particularly to SBKs operating inside a wellbore to extract oil and/or gas by generating steam from the water in the matrix rock, breaking it up and increasing its permeability thus providing a pathway for the oil and gas heated in the microwave field to egress from the rock to the well.

A solution to the problem of formation of standing waves in existing SBKs is to immerse the beam in a much stronger magnetic field than Brillouin, perhaps by a factor as high as five, and hence not by a PPM field. For applications where SBK weight or size is important, this can be accomplished by a solenoid wrapped directly around the SBK cavities. In one aspect, such a solenoid can be of a diameter much smaller than that of the free standing electromagnets used in conventional klystrons.

The downhole high power microwave system and proposed methods disclosed herein provide an alternative to hydrofracturing that is environmentally sensitive and has the potential to improve fracturing efficiencies. One potential improvement of significance is that the released hydrocarbons can be extracted from the well while the microwave fracturing by a SBK is taking place. Another improvement is that chemicals, which are objected to by some, are not needed.

In practice, shale layers are not always close to the surface, and transmission lined to an antenna below may have prohibitive resistive losses. A solution is to lower the microwave source itself, equipped with an antenna, into the wellbore. A microwave source capable of producing adequate microwave power under these conditions is a SBK. The advantages of the SBK, provided it is equipped with a "wrap-on" solenoid as described below are: a) Lower voltage operation because of the higher SBK current, b) Higher average power because of increased surface area to dissipate resistive losses at the output cavity, c) Considerably lower diameter because of the special solenoid, designed to provide a confining magnetic field of about 5 times Brillouin field. The Brillouin field for the C-Band SBK example is quite low (about 200 Gauss) which suggests that the radial thickness of a "wrap on" solenoid to provide about 1000 Gauss is estimated to be less than an inch.

These features can be better understood from the following detailed description and with reference to the drawings below.

FIGURES

Various aspects of the present invention are described herein by way of example in conjunction with the following figures, wherein.

DESCRIPTION

Figure 1:
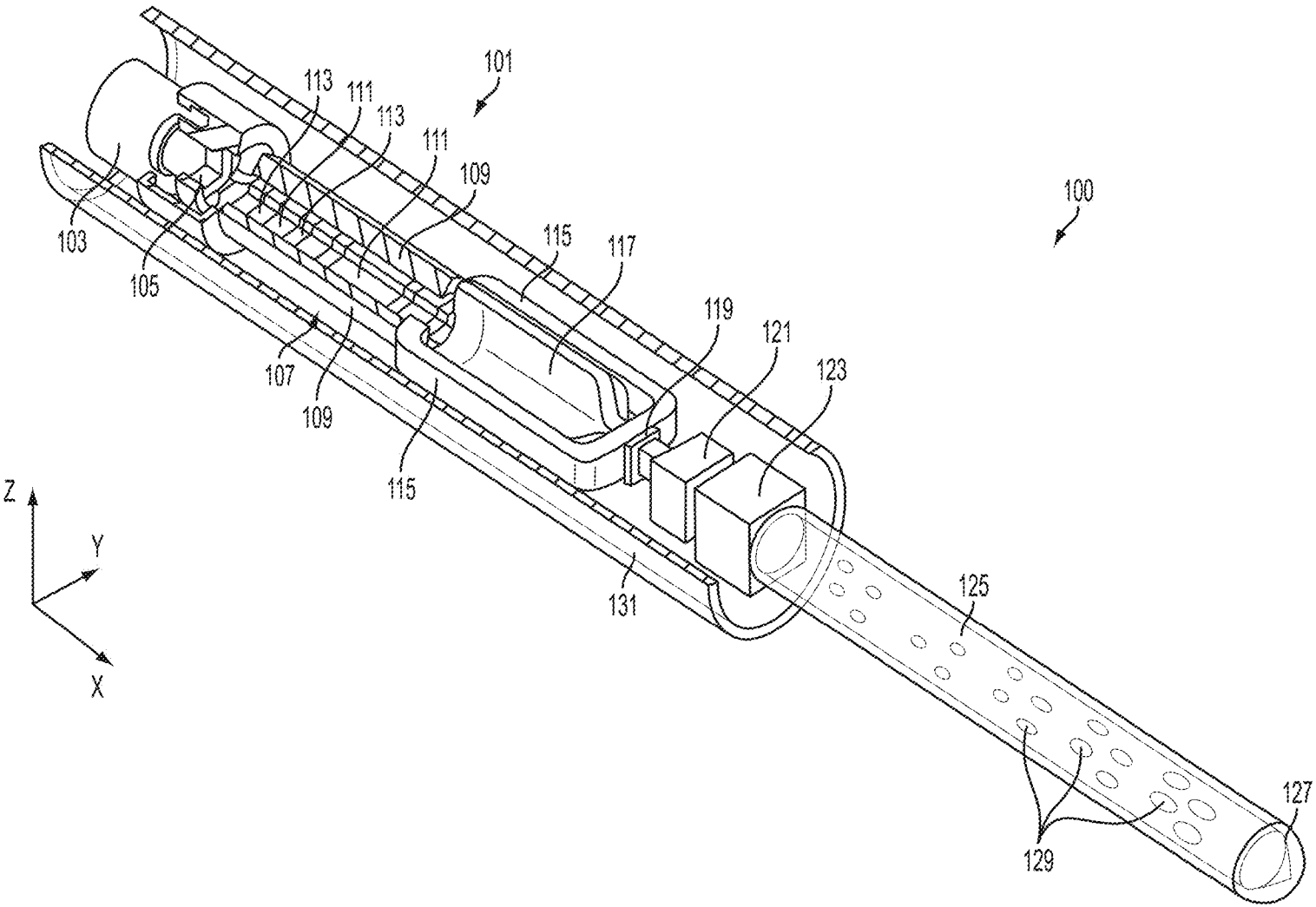
FIG. 1 is a diagram of a microwave tool according to one aspect of the present disclosure.
Figure 2:
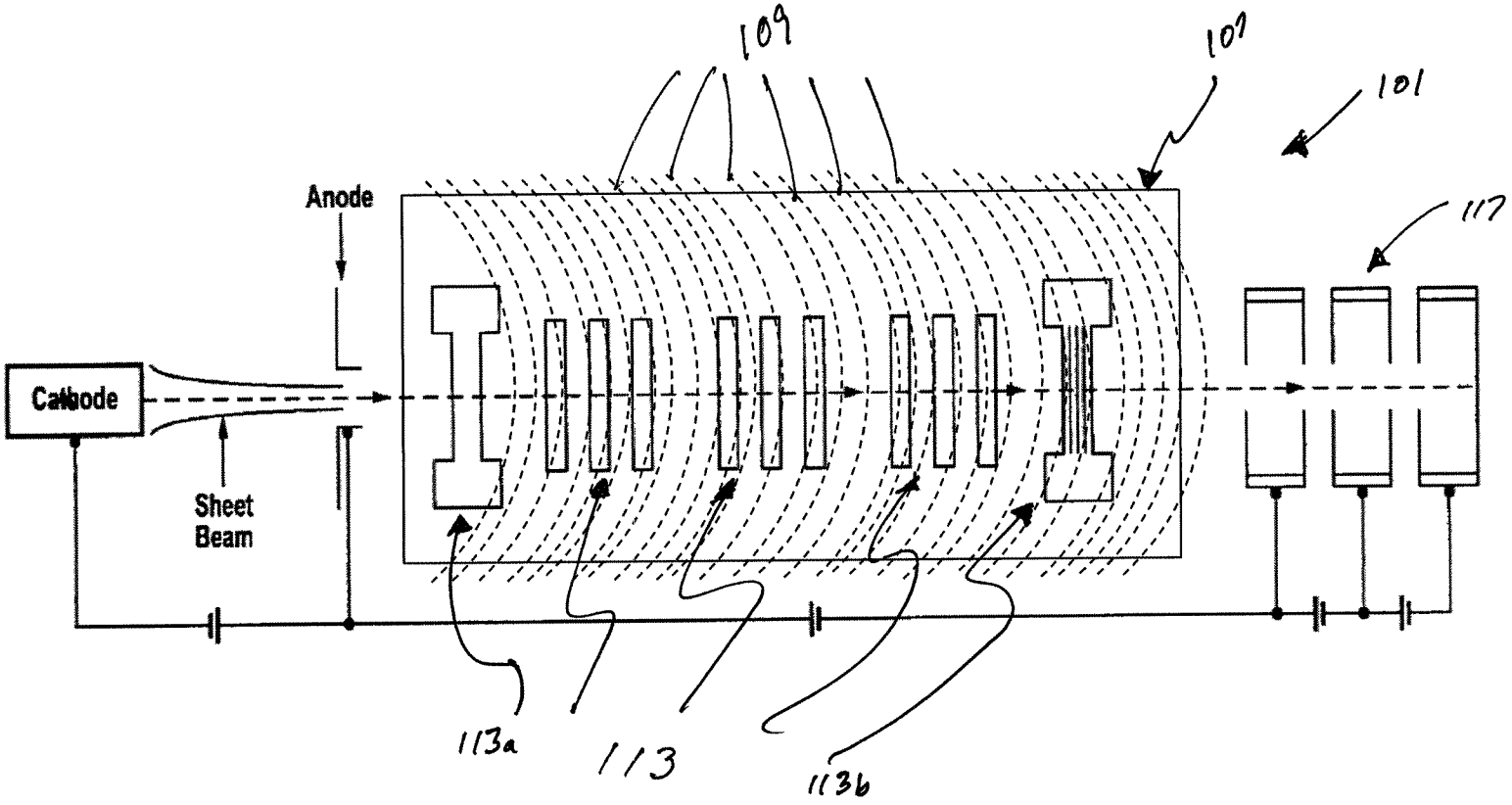
FIG. 2 is a schematic diagram of the microwave tool shown in FIG. 1.

With reference to FIGS. 1 and 2 an embodiment of a microware tool 100 is shown and described. The microwave tool 100 is configured to be inserted into an assumed bore hole 9 inches in diameter, but not limited to this diameter, and may be used as part of a high power microwave ("HPM") system. In the embodiment shown in FIG. 1, the microwave energy tool 100 comprises a Sheet Beam Klystron ("SBK") 101. The SBK 101 has an electron beam gun (not shown) coupled to a tube body 107 for carrying an electron sheet beam, and a magnetic solenoid 109 wound around the tube body 107. An electron beam is produced by the electron gun and travels from left to right within the tube body 107 and interacts with a plurality of cavities 113 of the tube body 107. The electron beam gun (not shown) has a gun ceramic 103 and a cathode 105 connected to the tube body 107. The cavities 113 may be made of sections of cut-off waveguide material that are referred to as cells and that are coupled to each other through the drift tube 111. Each cavity 113 may have a predetermined resonant frequency at which the cavity is designed to operate. More details regarding sheet beam klystrons may be found in U.S. Pat. No. 8,076,853, which is incorporated by reference herein in its entirety.

There can be a range in the number of cavities 113, such as, for example, five cavities 113 as shown in FIG. 1. Increasing the number of cavities may increase the power output of the microwave tool 100. The cavities 113 can be C-band resonant cavities such that they have a resonant frequency in the C-band range of the electromagnetic spectrum, as defined by the IEEE, which is the frequency band from approximately 4 GHz to 8 GHz and includes slight variations therefrom. The cavities 113 can also have a resonant frequency that is higher or lower than the C-band. Further, the five cavities 113 may be 3-cell extended interaction resonant cavities that are designed to resonant at a targeted or desired frequency, such as for example, a frequency within the C-band. Also, less than five, or none, of the cavities 113 may be 3-cell cavities. In addition, a 3-cell cavity can be used at the output cavity 113 because that is where the electric fields are higher.

Rectangular waveguides 115 from the two symmetrical outputs of the output cavity can be directed past the SBK collector 117 through two ceramic windows (not shown), which are transparent to the microwaves, to a waveguide combiner 119 that is followed by a circulator 121. The waveguide combiner 119 acts to increase the power by combining the output of the waveguides and the circulator 121 protects from arcs and other damage. It is designed to act with a dummy load that receives power reflections. In particular, the circulator 121 can function to shield the windows from potential load mismatches that produce power reflections. A transducer or mode converter 123 is shown connected to the circulator, and the mode converter 123 is designed to transform a rectangular waveguide TE10 mode from the waveguide 115 into a circular waveguide TE01 mode. The conversion from a rectangular waveguide TE10 mode into a circular waveguide TE01 mode allows for operation of the antenna 125 connected to the mode converter 123. The antenna may be directional or omni-directional; an omnidirectional antenna 125 is shown in FIG. 1 enclosed in a quartz antenna protector 127. As shown in FIG. 1, the antenna 125 can comprise antenna slots 129 that emit the microwave power from the microwave tool 1. The antenna slots 129 are shown as being circularly symmetrical and increasing in size towards a distal end of the directional antenna, however, different shapes, sizes, and patterns may be present based on a desired configuration and radiation pattern of the antenna 125.

FIG. 2 is a schematic diagram of the SBK 101 shown in FIG. 1. The wires of the magnetic solenoid 109 are shown in dotted line surrounding the plurality of cavities 113 of the tube body 107. The electron sheet beam interacts with the cavities 113 and ends up at the collector 117, where the energy that is not taken off by the output waveguide is lost as heat. Between each set of cavities 113 there are drift tunnels 111 of various lengths. The electron beam exchanges its kinetic energy with the cavities 113, initially with input cavity 113*a*, with the result that part of the kinetic energy is eventually converted to RF power at the final, or output, cavity 113*b*, where it is delivered to two waveguides 115 (shown in FIG. 1). The electron gun and waveguides 115, with ceramic windows (not shown), are attached and the drift tubes 111 may be exhausted and baked to obtain a high vacuum. The heat from the power dissipated at the cavities 113 and the collector 117, which is approximately one-half of the beam power, may be cooled by water passages (not shown) on the back of the tube body 107.

Communication between cavities 113 from input to output is maintained only through the beam. The drift tubes 111 between cavities 113 are cut off for the transverse magnetic modes, which the character of the cavity fields would introduce there because of the short drift tube height. However, transverse electric modes can propagate in the drift tubes 111 and produce growing electric field instabilities that can cause considerable beam interception at the broad sides of the drift tubes 111. Since the useful signals are carried by only the beam through the drift tubes 111, introducing ohmic loss in the drift tubes 111 will suppress unwanted electric fields there, allowing good beam transmission. Drift tubes 111 and cavities 113 in klystrons may be fabricated with a suitable high electrical and heat conductivity material, which may include, for example, copper. Also, a material with the chemical designation of C/SiC and consisting of carbon fibers imbedded in a ceramic matrix may be used for the drift tubes and cavities. This material is machinable and can be fabricated into two inserts placed into spaces in the cavity plates, forming C/SiC drift tubes between every pair of cavities.

Figure 3:
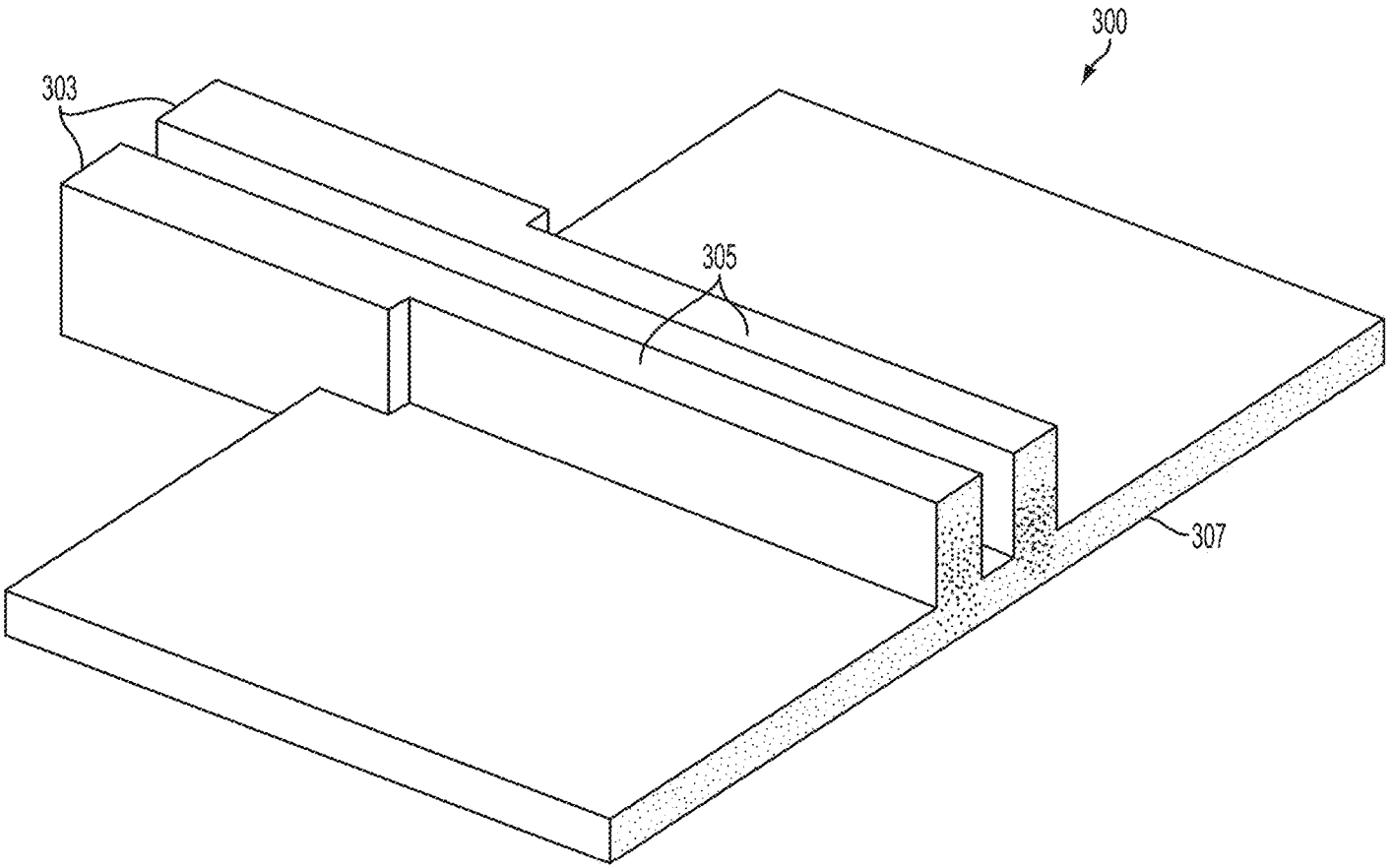
FIG. 3 is a diagram of a quarter section of a two-cell sheet beam cavity according to one aspect of the present disclosure.
Figure 4:
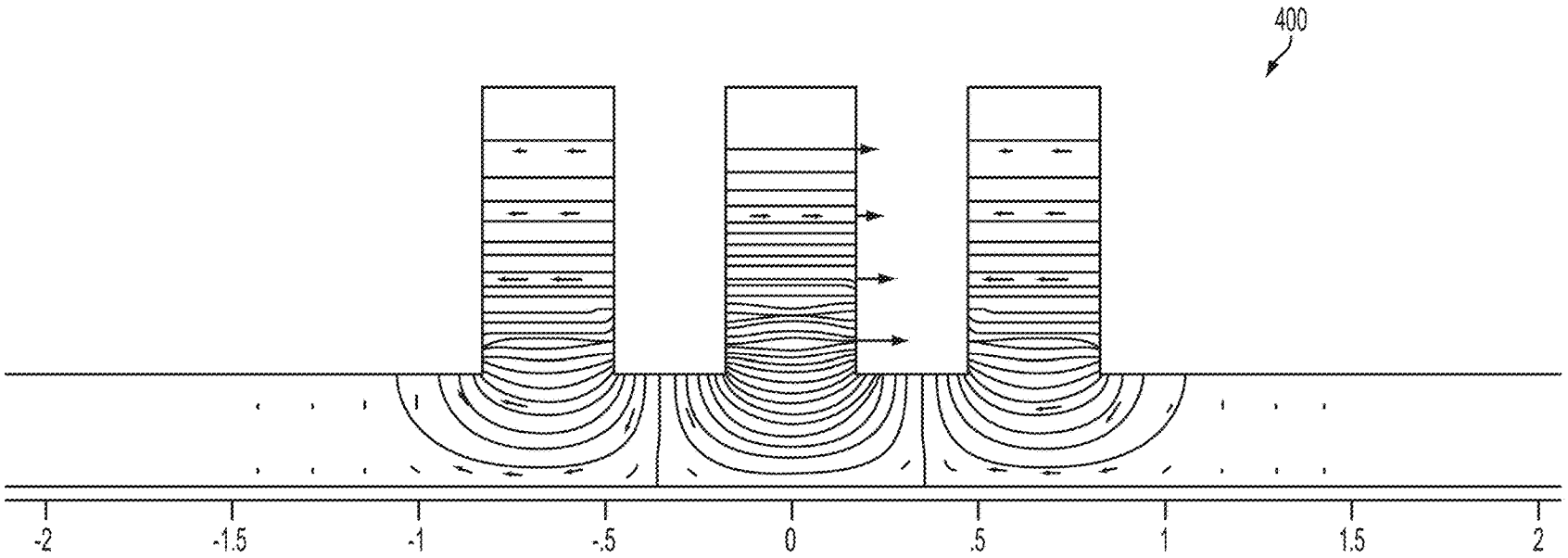
FIG. 4 is a diagram of a half section of a three-cell sheet beam cavity according to one aspect of the present disclosure.

FIGS. 3 and 4 illustrate details of the SBK cavities 113. FIG. 3 shows a quarter section of a two-cell SBK cavity 300. The quarter section 301 comprises quarter wave terminations 303 and cut-off waveguide sections 305 that are connected to a section of drift tube 307. Opposite electric fields from the cut-off waveguide sections 305 act on the electron beam as it travels inside the drift tube. FIG. 4 shows a half-section of a 3-cell cavity 400 that is designed to operate in the π-mode. The electron beam operates from left to right in FIG. 4. By operating in the π-mode, this means that, at the beam voltage of 75 kV, electrons traversing the cavity encounter reversing electric fields between cells at the resonant frequency of each cavity. The reason for the 3-cell cavities is two-fold. First, the π-mode produces a relatively high coupling coefficient, which is an important parameter for good SBK gain and efficiency. Secondly, the heat from ohmic losses is distributed over a larger surface particularly at the 5th output cavity where the electric fields are high.

As shown in FIGS. 1 and 2, a magnetic solenoid 109 is made up of wires wound around the drift tubes 111 and the cavities 113. The magnetic solenoid 109 is configured to produce a magnetic field that is applied to the electron beam of the SBK 101 such that the magnetic field produced by the magnetic solenoid 109 confines the electron beam in the drift tubes 111. According to embodiments, the solenoid 109 produces a higher magnetic field than that used with periodic permanent magnet ("PPM") focusing. The magnetic solenoid 109 can comprise conductive wiring wound directly on the tube body 107. The magnetic solenoid can be configured to produce a magnetic field that is at least 5 times greater than a Brillouin field for the electron beam. For example, the magnetic solenoid 109 can be configured to produce a magnetic field of about 1000 Gauss.

The microwave tool 100 may be sized and configured to fit within predefined dimensions based on the environment in which the microwave tool 1 is to be used. The size of the SBK 101 is limited by the size of the bore. For an assumed bore diameter of 9 inches, an SBK 101 according to the present disclosure can deliver a maximum power of 0.5 megawatt CW. This is more than twice the power of a conventional klystron and is accomplished because the cylindrical beam of a conventional klystron, at the same beam voltage (125 kV) of the SBK according to the present disclosure, could not be operated at the same current (17 A) because the dimensions of the conventional klystron beam would result in a higher current density than magnetic confinement of the beam could make possible. In a preferred embodiment, the SBK 101 may output 500 kW CW microwave energy in the C-band frequency band (4-8 GHz), preferably about, 7 GHz, and may operate at 75 kilovolts, 14 Amperes DC. It is possible to operate the SBK at higher frequencies, but the magnetic field strength required is higher since any interaction with the beam has to happen equally.

The microwave tool 100 may also have a housing that is placed around the magnetic solenoid, the tube body, and other components. The material and dimensions of the housing are determined by the location in which the microwave tool 100 is to be placed. In general, the overall dimensions of the cavity plates of an SBK are inversely proportional to the wavelength at which they operate. Further, the diameter of a magnetic solenoid coil is based on the y-direction of the tube body of the SBK. Therefore, the length, width, and height of a microwave tool 100 may vary. The material of the housing may be based on the environment of that the microwave tool 100 is to be placed and may allow for flexibility in the dimensions of the housing. As such, the housing may be made out of a metallic or non-metallic substance, including, as non-exhaustive examples, plastic, fiberglass, aluminum, and stainless steel. Accordingly, the housing may take on cylindrical, rectangular, triangular, or other symmetric or asymmetric shapes appropriate to fit in a particular space. For example, a cylindrical metallic housing may be employed with a maximum dimension in the y-direction that is less than 9 inches to fit within a borehole designed for recovery of natural gas.

As shown in FIG. 1, the SBK may be located inside a stainless steel container 131 that acts as the housing and allows high voltage connections for the gun, and coolant for the SBK drift tube cavities 113 and collector 117. The container 131 also allows for power to be supplied to the solenoid 109. The stainless steel container 131 terminates in the quartz enclosure 127 designed to protect the antenna 125 when the microwave tool 100 is placed inside a well bore. The diameter of the tool 100 can be approximately 8 inches, allowing a half-inch radial clearance between the tool and the well bore to pump oil to the surface.

Additionally, a method of manufacturing a microwave energy tool may comprise configuring a Sheet Beam Klystron ("SBK") to receive a wound-on magnetic solenoid and placing a wound-on magnetic solenoid directly on a tube body of the SBK. The wound-on magnetic solenoid is configured to immerse an electron beam of the SBK in a magnetic field that is at least five times stronger than a Brillouin field of the electron beam. In an embodiment, placing the magnetic solenoid directly on the tube body of the SBK may comprise winding the magnetic solenoid around the tube body of the SBK.

Microwave fracturing is accomplished by a High Power Microwave ("HPM") system, which includes the microwave energy tool described above, and the method of placing the system at the selected level (the target area) and controlling the fracturing from the surface. In one aspect, surface components of the downhole system include a 400 cycle turbine generator, or similar source, which supplies electrical power for the system. The output of the electrical generator is applied to an electrical control unit that contains, but is not limited to, a crowbar, a transformer, a filter and a power supply to provide DC power to the subsurface or downhole high power microwave system. In one aspect, a reinforced flexible tube, which is compartmentalized, carries electrical wire to power the downhole microwave system, has a pair of chambers to carry coolant to and from the system downhole and carries a selected number of wires for monitoring the downhole conditions, such as temperature and pressure, and for control signals for various functions downhole, such as moving the system up, down or rotational. A high capacity cooling system is connected to the flexible tube through a pump to maintain an adequate supply of coolant for the downhole high power microwave system. This coolant may be a typical coolant, and a particularly good coolant is water, for example. The system may be deployed downhole by using a large motorized dram capable of holding substantial lengths of flexible tubing and interchangeable with additional drums depending on the depths to be treated. A pulley, connected to the well head manifold, directs the system into the well. A blow out preventer, common to oil and gas wells, is employed. A compression assembly secures the tube and provides an air tight seal during operation of the system.

The well head manifold directs vapors from the well to a condenser that collects hydrocarbon vapors or directs them to the power generator as a fuel source. A valve is used to control downhole pressure for development of superheated fluids from in-situ water or other in-situ fluids to aid in the extraction of hydrocarbons. The well may be encased, with the casing extending from the surface and almost to the subsurface target area. Also the well may not have the usual casing, but may be encased over a selected length from the lower end up the selected distance with a low dielectric loss sleeve or casing.

The major system components placed downhole are the termination of the components in the flexible tube, including the microwave energy tool, a directional (or omni-directional) antenna, a dummy load and a circulator to direct the microwave beam to the antenna and reflected waves to the dummy load. The system further includes an orientation tool, which may be a carrier having flexible positioning arms and motorized wheels, that allows surface operators to place the antenna at the desired depth and radiation direction. Commonly used well field tools such as, but not limited to, gyroscopes or flux gate compasses can be used to provide the information for orientation of the system in various directions. The flexible tube, with power and instrument cables, is attached to a manifold near the microwave source which directs power and the cooling system to the SBK tube and other components. The SBK tube provides, but is not limited to, 0.5 megawatt ("MW") of power at a frequency of, but not limited to, 6 to 8 GHz. Microwave power is emitted from the SBK via a short wave guide, with an arc detector, coupled to the circulator. A purpose of the circulator is to protect the klystron tube by shifting the phase of reflected power to a separate output wave guide connected with the water or coolant cooled dummy load where reflected power is coupled into coolant, such as water, to prevent damage to the klystron tube. The antenna is preferably cooled by the coolant and may be a phased array antenna, for example. The antenna is capable of radiating a directional beam in various radiation patterns depending on the proposed fracture patterns. The antenna radiates in a selected pattern and is directed to cover sectors, such as 30 degrees or 60 degrees, for example. The coolant for the system components is directed by coolant tubes along the SBK, circulator, dummy load and antenna. The system components listed above are major equipment items. Other components which may be included are additional arc detectors and monitoring equipment.

Several different applications are possible for emitting microwave radiation into the subsurface while protecting the downhole microwave system. Thus, another component of the system is a low dielectric loss sleeve or a low dielectric loss permeable well casing. Where the hole or bore is encased with casing material like steel, the sleeve is comprised of, but not limited to, a perforated fused quartz or a ceramic cylinder that seats into a shoe at the base of the steel casing. Numerous holes in the fused quartz or ceramic cylinder can be used as a sleeve that will protect the equipment while radiating in a subsurface target area. Using well logging and geophysical data to select target zones, high power microwave energy will be emitted from the antenna in specific patterns to create migrating phase boundaries that will fracture the rock and create specified zones of increased permeability. As a selected zone is completed, the sleeve and the system are pulled back to another target area and the process repeated. The other option is to case a selected length of the well with a permeable low-loss well casing and radiate either selected target zones or the entire target formation through the low loss dielectric sleeve.

The high power microwave system is designed to either produce hydrocarbons from subsurface target areas or to increase the permeability surrounding the well by increasing interconnected porosity and fracturing the rock by dielectric heating of in-situ water and hydrocarbons. For dielectric heating to efficiently heat the rock, frequencies must be high enough to exclude ionic heating-generally greater than 1 GHz. Efficient dielectric heating for purposes of hydrocarbon removal occurs in the 2 to 10 GHz range, but is not limited to the upper frequency range.

In use, the system is lowered into the well using the flexible tubing system that contains duel cooling chambers or tubes, reinforced power cable, and instrument cables. The system can be used in either vertical or horizontal wells. The high power microwave system of a microwave energy tool that comprises an SBK, antenna, circulator, dummy load and ancillary components can be lowered into a vertical shaft or a vertical shaft which curves and becomes a horizontal shaft. A carriage, having preferably motorized wheels and tensioning arms pressing against the inside of the casing and attached to some of the components of the high power microwave system, guides the system down and along the casing. The carriage preferably positions the system in the center of the casing.

The method of inducing increased permeability at a selected target area downhole in a bare well or an encased well may comprise the steps of lowering a system comprising an SBK with a magnetic solenoid wound around a tube body of the SBK as the source of microwave energy, a directional antenna, a dummy load and a circulator coupled between the source and the antenna to direct reflected energy from the antenna to the dummy load. The system may then be positioned with the antenna in the target area and pointing in the selected direction. DC power can be applied to the klystron through a power cable from a generator on the surface. The DC voltage may be started at a selected lower level and increased to an operating level in response to a measured parameter downhole or on a set schedule.

A coolant may be sent from the surface through one chamber in the flexible tubing to cool the source, circulator, dummy load and antenna and then back to the surface through the second chamber in the flexible tubing.

The temperature of the various components, the pressure of an enclosed well, the frequency of the source and flow rates and other parameters may be measured and controlled during and after fracturing.

If a sector is covered by the radiation of the antenna, upon completion of the fracturing in this sector the antenna can be rotated to cover the next sector. To rotate the antenna the flexible tubing may be twisted clockwise or counterclockwise as needed. Otherwise the tubing may be terminated in a manifold above the klystron and the wires, cable and tubes distributed as required so that individual components or groups may be selectively rotated.

Unlike conventional hydrofracturing operations, in some instances it may be unnecessary to introduce water into the formation to create permeability enhancements. A focused beam is used to direct microwave energy in any direction to remove water and hydrocarbons plus increase permeability. Issues with injecting water that dissolves tight shale and decreases permeability are eliminated.

Several operational methodologies are possible using the HPM system depending on the type of well, the direct production of hydrocarbons, or the development of permeability zones surrounding the well to increase long term production. Relatively shallow vertical wells, down to about 2000 feet, in oil shale deposits of the Western United States and other locations can be drilled and the HPM system used to produce a very high percent of the hydrocarbons in a radial distance. Kerogen can be liquefied and pumped to the surface using submersible pumps. Gases collected at the surface can be either sold and/or used to power on site generators.

For deep shale deposits, microwaves can produce hydrocarbons or be used to increase the permeability surrounding hydrocarbon wells for future production. The HPM system can be used in a similar manner as multistage hydrofracturing where selected areas of the well are radiated to increase permeability in selected subsurface regions. Using the HPM system, it is possible to increase the permeability of a cylinder surrounding the well, to provide a large surface area interface between permeable rock created by microwave heating and the ambient hydrocarbon producing rock. The ability to direct microwave energy to any location in the subsurface provides flexibility in developing optimal production from various hydrocarbons subsurface reservoirs.

The apparatus and method of this invention provide an enhanced zone of intrinsic permeability surrounding bore holes that increases production rates for new or existing wells located in subsurface gas or petroleum reservoirs. A permeable skin region is created around the well bore that extends several meters radially from the well bore.

The system for extracting and recovering hydrocarbons from subsurface target formations may be a closed system downhole with pressure control to most effectively extract hydrocarbons from rock, such as oil shale. Oil shale typically contains a minimum of 2% to 4% of water. If there is insufficient water in the target formation, water may be added through an encased bore hole.

The water and/or other fluids, such as kerogen, in the target formation is superheated and causes fracturing of the rock. Further, the superheated fluid[s], from the target formation or added, causes the pressure to increase to push the liquefied or volatized hydrocarbon to the surface. These hydrocarbons are collected in a tank and recovered.

Critical or superheated fluids, such as water which has a critical temperature of 647.3 degrees K. and a critical pressure of 218.3 atm. or methane which has a critical temperature of 190.4 degrees K at 45.4 atm. can be created either in-situ or added to the system to act as organic solvents to enhance hydrocarbon removal. The microwave recovery system controls downhole pressure and temperature necessary for the enhanced recovery of hydrocarbons via critical fluids.

The pressure created by the superheated water or steam may be controlled by controlling the microwave power applied to the antenna positioned in the target formation. Further, the frequency of the output of the microwave source may advantageously be 2.45 Gigahertz, which is the closest frequency to the resonance of water.

Figure 5:
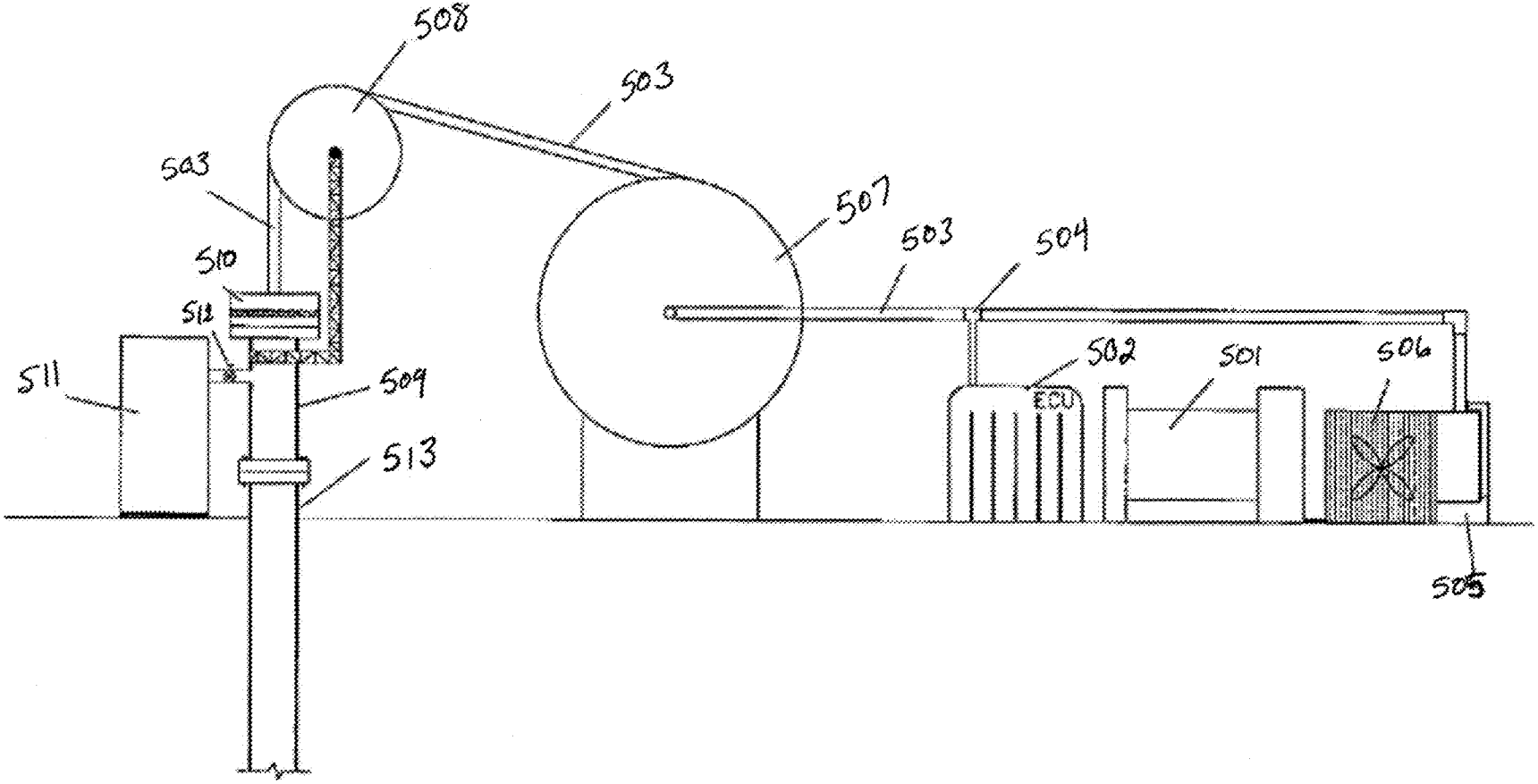
FIG. 5 is a diagram of the surface components of a high power microwave system according to one aspect of the present disclosure.

Aspects of the downhole microwave system are illustrated in the drawings and will be described in detail herein. FIG. 5 illustrates the surface components of the downhole HPM system. A turbine generator 501, or similar source, at the surface of the well supplies electrical power for the system. The output of the electrical generator 501 is applied to an electrical control unit 502 that contains, but is not limited to, a crowbar, transformer, filter and power supply to provide DC power to the subsurface HPM system. DC power is connected to the downhole system through a flexible tube 503 via a coupler 504.

As shown in FIG. 5, a pump 505 is connected to the dual chamber 727, 728 (shown in FIG. 7) of tube 503 with the high capacity cooling system 506 to maintain an adequate supply of coolant, such as water, for the downhole HPM system.

FIG. 5 illustrates the HPM system is deployed downhole using a large motorized drum 507 capable of holding substantial lengths of flexible tubing 503 and interchangeable with additional drums depending on the depths to be treated. A pulley 508 is connected to a well head manifold 509 and directs the HPM system into the well. A blow out preventer, common to oil and gas wells, is not shown. A compression assembly 510 secures the flexible tube 503 and provides an air tight seal during operation of the system.

The well head manifold 509 directs vapors from the well to a condenser 511 that collects hydrocarbon vapors or directs them to the power generator as a fuel source and/or to a separator for collection. A valve 512 is used to control downhole pressure for development of superheated fluids from in-situ water, or other in-situ fluids, to aid in the extraction of hydrocarbons. The system is attached to the well casing 513 that extends to the subsurface target area.

Figure 7:
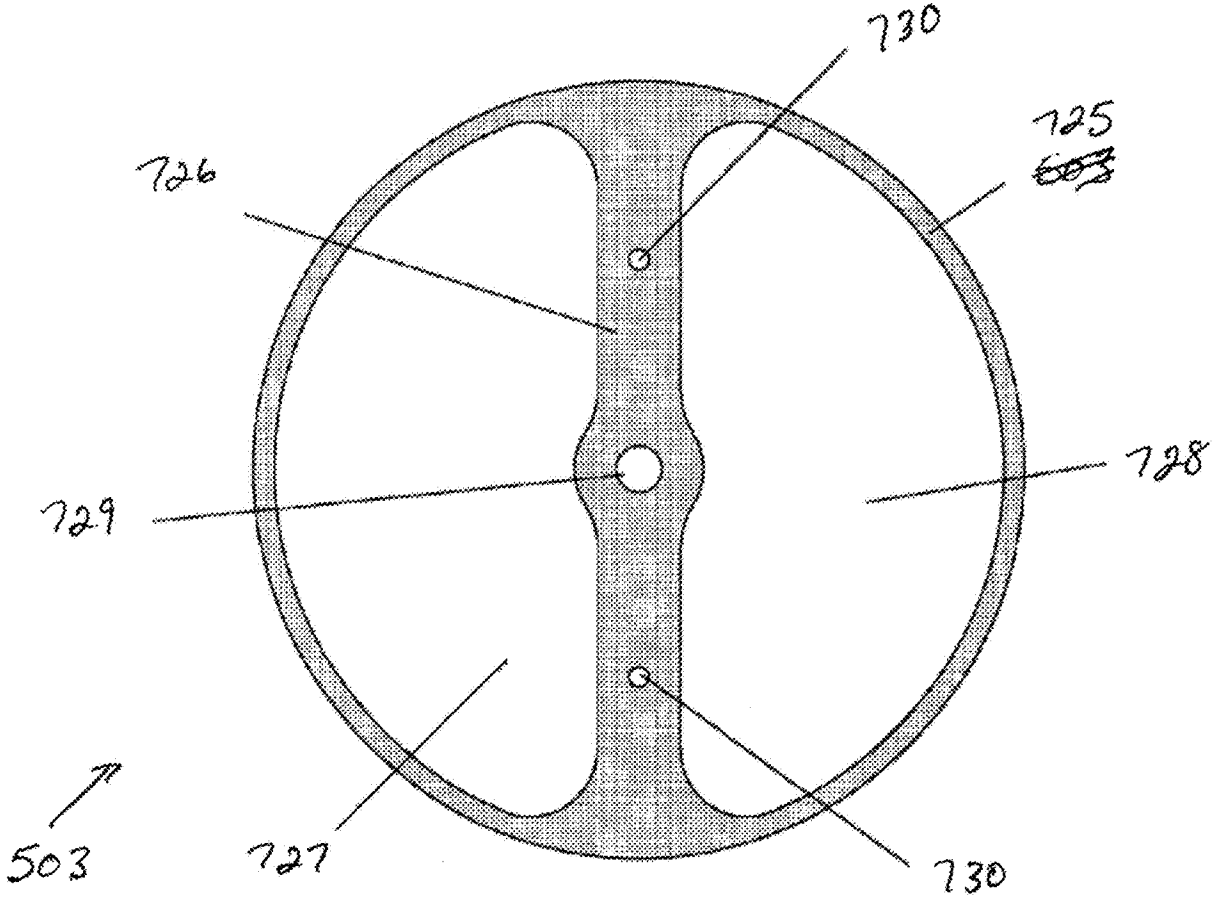
FIG. 7 is a cross sectional diagram of flexible tubing with reinforced power cables and cooling tubes according to one aspect of the present disclosure.

FIG. 7 illustrates a cross sectional view of the dual chamber of flexible tube 503 that is used to lower the HPM system into the well and to retrieve the system out of the well, according to some embodiments of the present invention. The flexible tube 503 includes reinforced flexible tubing 725 capable of supporting the weight of the HPM system at depths consistent with conventional oil and gas wells. The interior of the flexible tubing 725 is divided by a septum 726 that creates dual chambers 727 and 728. Tension cables can be added in the septum 726 if necessary to support the weight of the HPM system. One chamber 727 is used to input coolant, such as water, from the surface to the HPM system while the other chamber 728 is used for the return flow of heated water that is sent to a high capacity cooling system 506. An insulated DC power cable 729 is located in the center of the septum 726 to provide power to the klystron tube. Instrument cables 730, not limited to two, are also contained within the septum 726. The instrument cables provide information from, but not limited to, downhole instruments that monitor HPM location, arcing, temperature, and pressure, as well as a way of controlling downhole environment, operating conditions and components, like a carriage for up/down movement and rotation.

Figure 6:
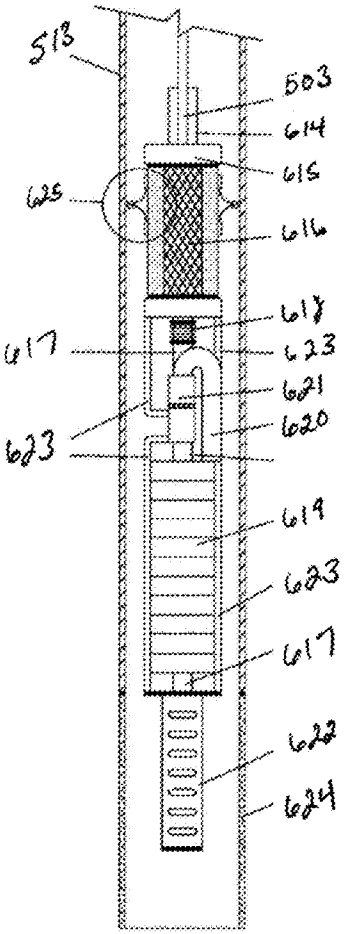
FIG. 6 is a front view of downhole components of a high power microwave system according to one aspect of the present disclosure.
Figure 8:
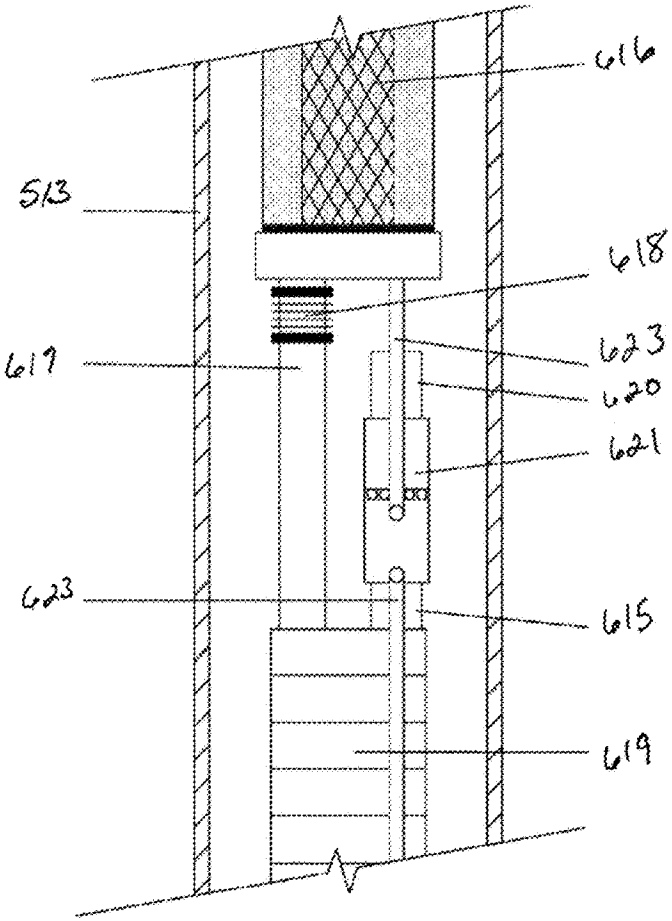
FIG. 8 is a side view of components of the system shown in FIG. 5.
Figure 9:
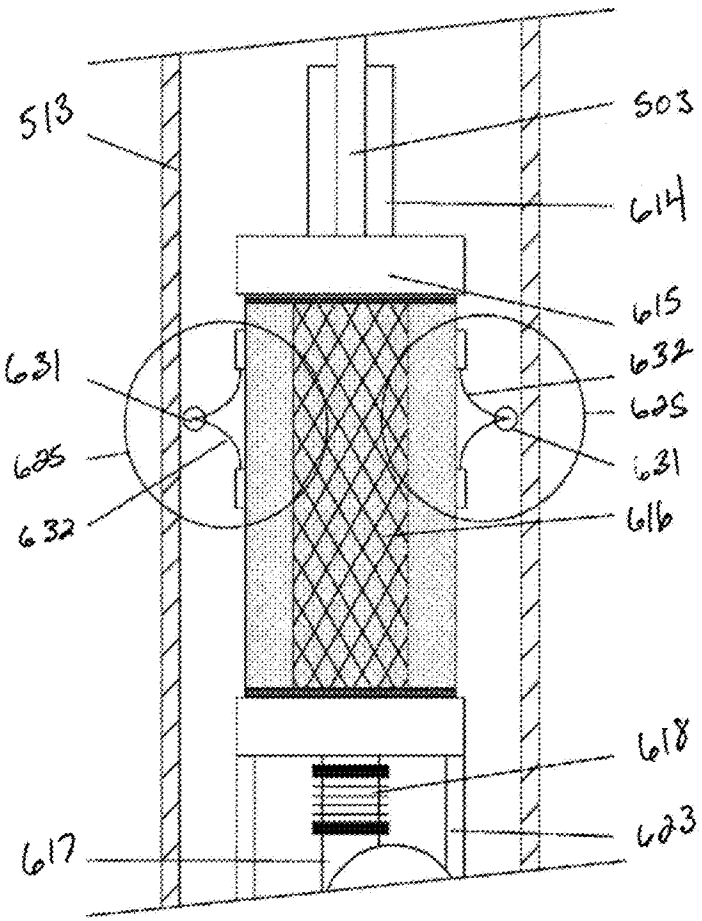
FIG. 9 is a front view of a carriage used for insertion and positioning of the system shown in FIG. 5.

FIGS. 6, 8, and 9 illustrate major system components placed in the well, according to some embodiments of the present invention. As shown in FIGS. 6 and 9, an orientation tool 614 allows surface operators to place the radiating antenna 622 of the system at the desired depth within the target zone or area and to direct the antenna in the desired radiation direction. Alternatively or additionally, other positioning tools may be employed, such as the carriage 625 shown in FIGS. 6 and 9, or the like. Commonly used well field tools such as, but not limited to, gyroscopes or flux gate compasses provide the information for orientation of the system in various directions. The flexible tube 503 with dual coolant chambers and power and instrument cables is attached to a manifold 615 that directs power and the cooling system to the SBK tube 616.

FIG. 9 illustrates one type of orientation tool, according to some embodiments of the present invention. A carriage 625 has three or more flexible arms 631 spaced at intervals around one or more of the components of the system. The intervals are preferably 130 degrees or 90 degrees. The carriage 625 is shown attached to the klystron tube 616 in FIG. 9. Motorized rollers or wheels 632 engage the inner surface of the casing or low dielectric loss sleeve to move the system in the desired direction. The flexible arms 631 keep the wheels 632 in contact with the inner surface.

The size of the "down-hole" SBK is generally restricted by the size of the bore. As discussed above, for example, for an assumed bore diameter of 23 cm, or approximately 9 inches, a SBK can deliver a maximum power of 0.5 megawatt continuous wave ("CW"), which is more than twice the power of a conventional klystron. The typical steel casing in which the system of this application is used has a diameter of 9 inches. Other useful and relatively common casing sizes in which the system may be used have a 6 inch diameter or a 20 inch diameter.

Microwave power is emitted from the klystron tube 616 via a wave guide 617, with an arc detector 618, directly to a circulator 619. The waveguide 617 is a short waveguide that only has to be long enough to accommodate a dummy load 621 and connectors between the circulator 619 and the klystron 616. This places the source 616 near the antenna 622, which is in the target zone. The main purpose of the circulator 619 is to protect the klystron tube 616 by shifting the phase of reflected power to a separate output wave guide 620 connected with a water cooled dummy load 621. Reflected power from the antenna 622 is coupled into cooling water to prevent damage to the klystron tube. Another major component of the downhole equipment is the directional antenna or applicator 622. The antenna 622 is an applicator that is capable of radiating a directional beam in various radiation patterns to accomplish the desired fracture patterns. A water cooled phased array antenna provides the desired radiation pattern. Water tubes 623 provide coolant for the downhole system components. Other components which may be included are mode converters, additional arc detectors and monitoring equipment, for example.

FIGS. 6 and 8 illustrate one type of connection between the downhole components of the system. The waveguide 617 may be rectangular or some other appropriate configuration. Also, the dummy load 621 may be between the antenna 622 and the circulator 619 and the waveguide 617 could then be shorter to couple the klystron tube 616 to the circulator 619. In some embodiments, arc detectors are strategically placed in the waveguide to detect potential arcing problems and to immediately shut down the system if there is an arcing problem. The arc detectors and down hole sensors are integrated into the central control system 502 that monitors, but not limited to, electrical arcs, cooling water temperatures, off-gas temperatures, off-gas concentrations, and power conditions for the power supply and the klystron, and provides safety controls for the operation of the system.

Another component of the downhole system is a low dielectric loss sleeve 624 attached to the end of the well casing or steel pipe 513. If the well bore is not encased, a low dielectric loss permeable sleeve 624 extends up the well and functions as the well casing to protect the system components in the open well bore not cased with steel pipe 513. The sleeve may be comprised of, but not limited to, a perforated fused quartz or a ceramic cylinder that seats into a shoe at the base of the steel casing 513. Several different applications are possible for emitting microwave radiation into the subsurface while protecting the downhole microwave system. Numerous holes in a fused quartz or ceramic cylinder can be used to form the low dielectric loss sleeve that protects the equipment while radiating a subsurface target area.

Using well logging and geophysical data to select target zones, high power microwave energy is emitted from the antenna 622 in specific patterns to create migrating phase boundaries to fracture the rock and create specified zones of increased permeability. As a selected zone is completed, the sleeve 624 and the HPM system are pulled back to another target zone and the process repeated. An alternative to encasing the well down to the target area in steel is to encase an extended portion or the whole well with a permeable low-loss well casing and to radiate either selected target zones or the entire target formation without moving the sleeve or casing.

Each sector to be radiated is selected to most efficiently extract the desired hydrocarbons from the target formation. The smaller the angle of the sector radiated the greater the energy in the sector. An angle of 30° is useful for most target formations. The angle of the sector may be increased or decreased when appropriate. The process is continued until the majority of the region at a selected depth has been radiated in all directions. The antenna 622 is either raised or lowered, or moved to the right or left in a horizontal well, in the casing 513 and sleeve 624 to another region in the target formation and the process of launching phase boundaries in sequenced sectors repeated. This process is continued until the distance of the phase boundary from the antenna 622 results in diminishing hydrocarbon recovery rates which will dictate cessation of the process in that sector and eventually at the operating depth of the antenna and in the particular bore hole.

The downhole microwave system is capable of removing nearly 100 percent of the water and volatile hydrocarbons. Careful laboratory measurement of the loss tangent for rock material that has been previously placed in a microwave field has shown that it is possible to effectively microwave and remove water and hydrocarbons in a cylinder conservatively predicted to be 50 meters in diameter and the length of the production zone. In horizontal wells, distances of one or two thousand meters for the production zone are not uncommon.

An important advantage of not introducing water into the well over hydraulic fracturing is the residual moisture left alter hydrofracturing. Water introduced into a shale formation will cause some liquefaction or smearing of the shale reducing permeability at the fracture/shale interface. Once drilling fluids are removed from the well and the casing placed in the well to the depth of the target zone, no water is introduced into the well for the microwave process of this invention. Permeability enhancements remain constant during the life of the well since all water is removed in microwaved zones. Depletion in production rates will be reduced resulting in gas wells that produce high volumes of gas for longer durations.

A method of extracting hydrocarbons from the Earth may comprise inserting a microware tool that has an electron beam into a bore hole in the Earth, applying DC power to the microware tool, immersing the electron beam of the microware tool in a magnetic field that is at least five times stronger than a Brillouin field of the electron beam, directing microwave energy of the microware tool using a directional antenna of the microwave tool, and collecting hydrocarbons released by the application of microwave energy from the microware tool. The microwave tool may comprise an SBK that has at least one cavity, which is designed with a resonant frequency in a frequency range between 4 GHz to 8 GHz. In another embodiment, applying the magnetic field to the drift tube of the SBK comprises operating the magnetic solenoid with a DC voltage that is lower than an operating voltage of the SBK.

The method of inducing increased permeability at a selected target area downhole in an open well or an encased well may comprise the steps lowering a system comprising the SBK 616, as the source of microwave energy, a directional antenna 622, a circulator 619 between the source and the antenna and a dummy load 21. The circulator directs reflected energy from the antenna 622 to the dummy load 621. The system is lowered to a selected depth, in either a vertical or a vertical and horizontal well, and is then positioned with the antenna 622 in the target area and pointing in the selected direction. A low dielectric loss sleeve or well casing around the antenna and source protect these components during and after fracturing. DC power is applied to the SBK 616 through a power cable 629 from the generator 501 on the surface and the electron beam of the SBK 616 is immersed in a magnetic field that is at least five times stronger than a Brillouin field of the electron beam. The DC voltage may be started at a selected lower level and increased to an operating level of 617 amps at 125 kilovolts. The increase may be in response to a measured parameter downhole or on a set schedule. Upon completion of the fracturing in the sector covered by the antenna, the antenna 622 is rotated to cover the next sector.

A coolant is recirculated from the surface through one chamber 627 in the flexible tubing 503, downhole in contact with the source 622, circulator 619, dummy load 621 and antenna 622 by way of coolant tubes 623 and then back to the surface through the second chamber 628 in the flexible tubing 503. The temperature of various components, the pressure of an enclosed well, the frequency of the source and flow rates and other parameters may be measured during and after fracturing.

There are several options for producing hydrocarbons from vertical or horizontal wells using the HPM system. In vertical wells, microwave heating can begin at the bottom of the target zone and moved upwards. As hydrocarbons, such as kerogen in oil shale deposits are heated, liquid kerogen will flow downward and toward the bottom of the well where it can be collected and pumped to the surface. Once the kerogen is removed, the well can be completed as a conventional gas well. For horizontal wells, there are several options available to produce hydrocarbons. Multi-stage fracturing at selected intervals, similar to hydrofracturing, can be achieved using the microwave system. It is also possible to remove nearly 100 percent of the hydrocarbons in a cylinder surrounding a horizontal well for the entire length of the well within the target zone. The depth of the target area may be in excess of 10,000 feet with the antenna and the system being positioned at this depth.

The system does not require the use of large volumes of water or chemicals that could potentially impact the environment, or large quantities of sand, all of which are necessary for a conventional hydrofracturing operation. The oil and gas industry relies on competent well construction to prevent potentially toxic chemicals used in hydrofracturing from contaminating valuable groundwater supplies. Effective disposal of water and chemicals used in hydrofracturing relies on cooperation between industry and the regulatory community. A breakdown in this process could result in a catastrophic release to the environment and large remediation costs. The HPM system relies on in-situ water and hydrocarbons to achieve fracturing of the rock. Outside sources of water or chemicals are not necessary for the performance of the high power microwave system. The costs of transport and disposal of hydrofracturing fluids is avoided and is a savings added in comparisons of technology efficiencies.

The presence of in-situ water provides another physical mechanism to improve hydrocarbon removal efficiencies. It is possible to control downhole temperatures and pressures with this microwave system. With the presence of water, super-heated steam can be created within the rock formations that will assist in stripping hydrocarbons from shale rocks.

The physical process of efficiently heating subsurface hydrocarbon deposits is based on launching a phase boundary in the subsurface using directed microwave energy, thereby heating the hydrocarbon to temperatures where liquefaction or vaporization occurs. As hydrocarbons are removed, the remaining rock absorbs limited amounts of energy allowing the phase boundary to continue to migrate radially from the access well. This phase boundary may radiate out 25 meters or more.

The pressure and temperature may be controlled to provide the pressure and temperature at which selected fluids become critical or super critical fluids. For example, methane is often present in the subsurface area and the pressure may be established at or above 45.4 atmospheres with a temperature at or above 190.4 degrees K. to create a critical or super critical fluid of the methane which acts as an organic solvent to enhance hydrocarbon removal. The pressure and temperature may also be controlled to create a critical or super critical fluid of the water in the target area.

As an alternative to or in addition to pressure in the well, a sump near the bottom of the well with piping to the exterior of the well (not shown) may be used to recover the hydrocarbons and other liquids or gases from the bottom of the well.

The microwave system may produce significant fracture densities and may cause solid blocks of shale to experience enhanced porous permeability from the radiation which can result in an increase of hydrocarbon production. Some photomicrographs of low permeable clay subjected to microwave heating show tracks or tunnels created by escaping gases. The effect of microwave heating can result in solid blocks of shale showing significant increases in primary permeability in addition to increases in permeability due to fractures.

Microwave heating will result in hydrocarbons being liquefied and vaporized, and transported from deep within the earth via a permeable pathway created by microwave heating and under an enhanced gradient from high pressures deep within the earth to atmospheric pressure at the earth's surface. Throughout this journey, some of the vapor will be kept within the microwave field. However, this vapor absorbs very little energy and allows the bulk of the energy to heat rock. Primary separation of various hydrocarbons within the microwave field during transport from the rock and during vapor collection on the surface is possible with the microwave system. Separated or partially separated hydrocarbon compounds will significantly reduce refining costs further increasing the economic value of the HPM System.

Once downhole microwave treatment has been completed, there will be a large surface area interface between the permeable microwaved rock and hydrocarbon producing ambient or country rock. The HPM system can increase permeability and can increase the surface area interface beyond the capabilities of hydrofracturing. More of hydrocarbon producing rock may be exposed to permeable pathways allowing for the increased production from wells as compared to conventional hydrofracturing. Low permeable country rock that exhibits low hydrocarbon desorption rates have a large cross sectional area for hydrocarbons to flow through permeable rock to the well. A natural gas well capable of producing large volumes of gas for long periods of time will be the ultimate result after the microwave removal of hydrocarbons and permeability enhancement is completed. No toxic chemicals are injected into the ground. There are no requirements for precious water resources or expensive disposal practices for the waste water and chemical.

Eventually, the highly permeable subsurface zones created by microwave treatment provide a reservoir for carbon sequestering. Carbon dioxide and other greenhouse gases can be sequestered in the same well that produced hydrocarbons by injecting these gases in liquid form back into the earth. This process may also be advantageous during active production where post-processed microwaved subsurface reservoirs are pressurized during carbon sequestering, thereby increasing the pressure gradient for active zones and forcing hydrocarbons into producing wells.

Systems and methods of the present disclosure may be implemented with several variations or modifications on the preferred embodiment described above. Some examples, although not exhaustive, include different size bore holes, different power for the klystron and different frequencies.

There are several applications for this improved klystron technology, including:

Inspection at seaports: Electron accelerators producing x-ray beams must be portable to scan the interior of moving trucks for clandestine materials. Consequently, the high power klystrons which feed them must also be portable, and hence lightweight. SBKs are ideal for this application, important for homeland security. As such an SBK having a magnetic solenoid wound around the tube body could be used for producing x-ray beams.

Medical Accelerators or Clinical Linear Accelerators ("CLINACs"): These involve a gantry rotating around the patient, and operate at 2.8 GHz. The trend for future CLINACs is to operate at a higher frequency, but the same power SBKs would be less expensive and could be placed in the gantry because of their much lower weight than the electromagnet-focused klystrons now in use. Accordingly, an SBK of the present disclosure could be used in place of CLINACs.

Active Denial Systems ("ADS"): This is a "nonlethal" military system for crowd dispersal. It directs 95 GHz power at hostile groups beyond small arms fire and exploits the property of millimeter waves of very shallow penetration in the skin, causing intense pain. Early versions of ADS employed gyrotrons, high power millimeter-wave oscillators, requiring super conducting magnets for their operation. These single power source systems proved impractical and the company that developed them (Raytheon) opted for modular systems employing arrays of small SBKs. The change in the system resulted in an intensive development of 95-GHz SBKs at SLAC and in the industry. Beam instabilities have proven to be a serious obstacle to this development. Accordingly, an SBK of the present disclosure could be used in place of the SBKs currently used in ADS systems.

While aspects of the present disclosure have been described in terms of a preferred embodiment, those skilled in the art will recognize that the present disclosure can be practiced with modification within the spirit and scope of the appended claims.

As disclosed herein, in one aspect, a Sheet Beam Klystron ("SBK") microwave amplifier comprises a solenoid wound directly on a tube body, and beam confinement is accomplished by the solenoid wound directly on the tube body. The SBK is operated with a DC voltage, much lower than the SBK beam voltage.

As disclosed herein, in another aspect, an SBK confining magnetic field is several times higher than the Brillouin field of the SBK beam.

As disclosed herein, in further aspect, a 7-GHz SBK with a solenoid wound directly on the tube body, produces a magnetic confinement field several times Brillouin, and can be placed inside a tool that can be lowered inside a well bore of approximately 9-inch diameter for the purpose of heating shale and extracting oil or gas that can be pumped to the surface.

In all other applications for which an SBK offers advantages in average power, size, weight or cost, an SBK equipped with a "wrap-on" solenoid can be effective.

What is claimed is:

1. A microwave energy tool comprising a mode converter coupled to the tube body of a sheet beam klystron, wherein the mode converter transforms a rectangular waveguide TE1O mode from the tube body into a circular waveguide TEO1 mode.

2. A method of extracting hydrocarbons from the Earth comprising:

inserting a microware tool that produces an electron beam into a bore hole in the Earth;

the microwave tool comprising:

a sheet beam klystron comprising a cathode, a collector, a tube body between the cathode and the collector for carrying an electron sheet beam, the tube body having one or more cavities and a plurality of drift tubes; and a magnetic solenoid comprising continuous conductive wiring wound directly on the tube body and thereby over the cavities;

applying DC power to the microware tool; and producing a magnetic field that is at least five times stronger than a Brillouin field of the electron beam with the magnetic solenoid such that the magnetic field produced by the magnetic solenoid confines the electron beam sheet in the tube body of the microwave tool.

3. The method of claim 2, wherein the cavities have a resonant frequency in a frequency range between 4 GHz to 8 GHz.

4. The method of claim 2, further comprising directing microwave energy of the microware tool into the Earth using an antenna of the microwave tool.

5. The method of claim 4, wherein the antenna is a directional antenna or an omni directional antenna.

6. The method of claim 4, further comprising collecting hydrocarbons released from the Earth by the application of microwave energy from the microware tool.

* * * * *